US006662513B2

(12) United States Patent
Rodlin

(10) Patent No.: US 6,662,513 B2
(45) Date of Patent: Dec. 16, 2003

(54) PRESHAPED FORM

(76) Inventor: Daniel W. Rodlin, 1627 Front St., No. 5, Oceano, CA (US) 93445

( * ) Notice: Subject to any disclaimer, the term of this patent is extended or adjusted under 35 U.S.C. 154(b) by 0 days.

(21) Appl. No.: 10/254,038

(22) Filed: Sep. 24, 2002

(65) Prior Publication Data

US 2003/0079429 A1 May 1, 2003

Related U.S. Application Data

(63) Continuation of application No. 08/967,055, filed on Nov. 10, 1997, which is a continuation-in-part of application No. 08/441,251, filed on May 15, 1995, now Pat. No. 5,685,116, which is a continuation of application No. 08/222,826, filed on Apr. 5, 1994, now abandoned.

(51) Int. Cl.[7] ..... E04C 5/01; E04F 13/04

(52) U.S. Cl. ..... 52/255; 52/344; 52/443; 52/716.1; 52/730.1

(58) Field of Search ..... 52/255, 256, 257, 52/730.1, 730.2, 311.1, 443, 454, 717.06, 344, 716.1

(56) References Cited

U.S. PATENT DOCUMENTS

| | | | | |
|---|---|---|---|---|
| 279,011 | A | * | 6/1883 | Phelps |
| 776,344 | A | * | 11/1904 | Nielson |
| 1,537,758 | A | * | 5/1925 | Fischer |
| 1,988,739 | A | * | 1/1935 | Jones |
| 2,005,572 | A | * | 6/1935 | Vass |
| 2,465,756 | A | * | 3/1949 | Schepis |
| 3,175,330 | A | * | 3/1965 | Holsman |
| 3,333,379 | A | * | 8/1967 | Harris |
| 3,412,512 | A | * | 11/1968 | Hollister |
| 5,625,986 | A | * | 5/1997 | Mansfield et al. |
| 5,685,116 | A | * | 11/1997 | Bradshaw et al. |
| 6,055,788 | A | * | 5/2000 | Martin et al. |

* cited by examiner

*Primary Examiner*—Robert Canfield
(74) *Attorney, Agent, or Firm*—Lawrence S. Cohen

(57) ABSTRACT

A prefabricated relief form member for use as an architectural feature on a structure formed alternatively by use of welded wire mesh, double wire welded wire mesh, corner beads fixed together, or woven wire mesh and optionally using corner beads at the corners of the top and sides, and having backing paper.

3 Claims, 7 Drawing Sheets

Fig. 11
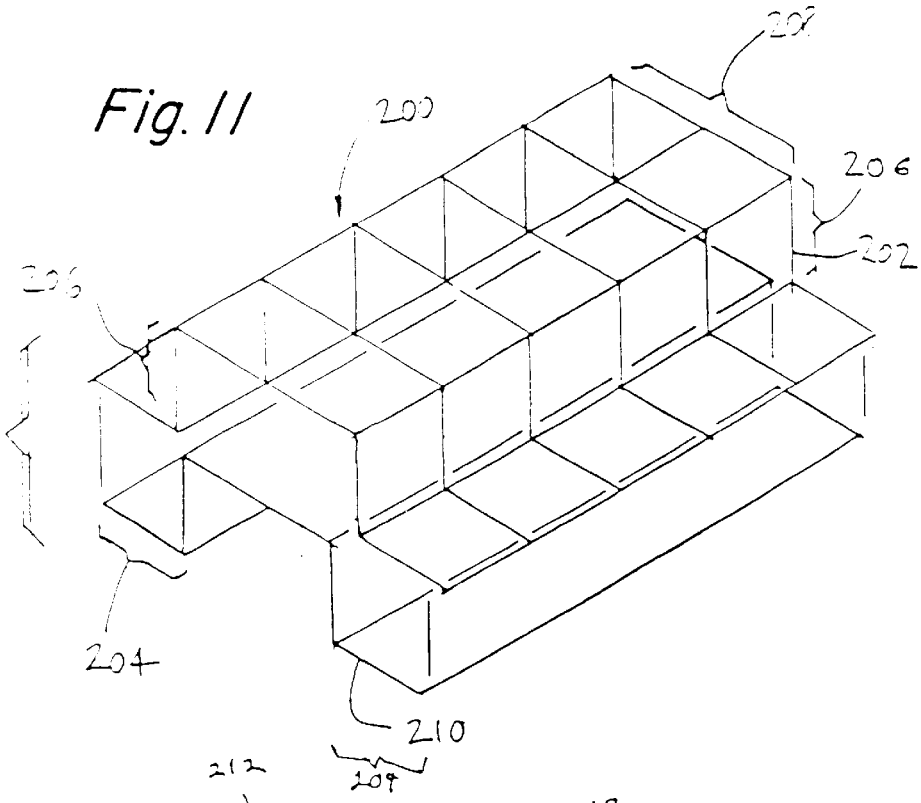
Fig. 12
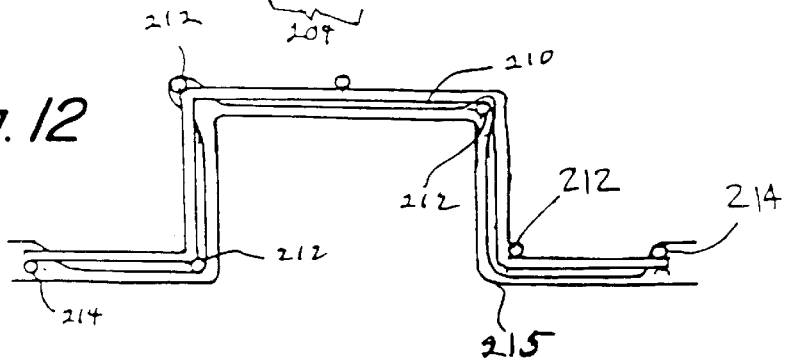
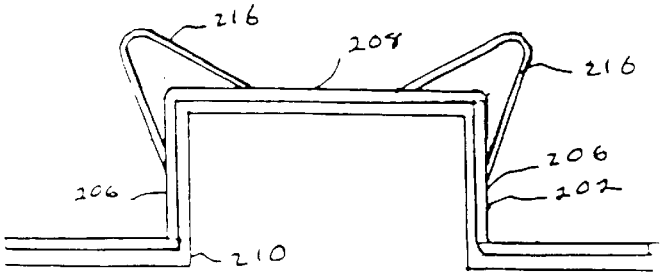
Fig. 13

PRESHAPED FORM

RELATED APPLICATIONS

This application is a continuation of patent application Ser. No. 08/967,055 filed on Nov. 10, 1997, ABANDONED which is a continuation in part of patent application Ser. No. 08/441,251 filed on May 15, 1995 issued as U.S. Pat. No. 5,685,116 on Nov. 11, 1997, which is a continuation of patent application Ser. No. 08/222,826 filed on Apr. 5, 1994 now abandoned, the contents of all prior applications being incorporated herein by reference.

BACKGROUND OF THE INVENTION

1. Field of the Invention

The invention relates to prefabricated, light-weight, plaster relief forms to provide quick, low cost, installation of support members for constructing plaster coated decorative "plant-on's" or "bump-outs" to the outside walls of dwelling structures.

2. Previous Art

Ornamentation and decoration of building structures such as residences and businesses is one important aspect of architecture. Marketing and sale of residences is enhanced by additional decorative detail. Pride of ownership is also enhanced by improved appearance of one's building or residence. Ornamentation and decorative details are used extensively to add desirability and attractiveness to structures.

In certain regions of the country, such as the West and Southwest, the homes in the Mission style, and the Mediterranean style are quite popular. One of the popular methods of ornamentation used for these styles of homes is referred to in the building trades as "plant-ons" or "bump-outs". The plant-ons may extend for a considerable length along the horizontal or vertical dimension of a wall or walls of a home or business. The plant-ons add a band or bands of relief to an otherwise blank façade that is presented by an unbroken expanse of plaster or stucco. The bands may extend completely around the outside perimeter of a building. For a conventional home of 2500 sq. ft., this may amount to 300–500 ft of bands for one single layer. The support for these bands are generally made of overlapping wooden boards including a first layer of 2×12 inches and a second layer of 2×8 inches. The boards are placed end to end in standard lengths of 8 to 12 ft to create a continuous relief band around the home. Similar bands may be constructed around door and window openings.

Attractive relief borders around windows and doors are also used to provide enhancements to the architecture of homes and buildings. Such window and door borders have been constructed using the above methods and materials.

These features are not necessary to the structural integrity of the building, but do add a pleasing visual aesthetic appearance to a home or business.

One example of architectural relief products for attachment to homes are pre-shaped foam members such as cornices, bases, sills and balusters, for example, supplied by High Tech Foam Products, Inc of Corona, Calif. Foam members may be provided in a wide variety of shapes and sizes. The disadvantage of these members as supports for relief bands include the expense of the items themselves, on the order of $5 to $6 per linear foot, and the additional labor and material involved in adding a layer of screening or lath material over the foam to provide a matrix for the plaster to adhere.

A conventional method of construction of plant-ons uses one or more planks of overlapping boards attached to a wall at a particular height. To achieve a continuous band or strip of relief, multiple lengths of uniform cross section boards are aligned end to end and attached to the studs of a prepared wall. For conventional construction, the studs must be no more than 24 inches on center, or less, according to the applicable local, state or national building codes. The attachment is done with hammer driven nails, power gun driven nails, large staple guns or the like. The boards are attached to the wall prior to the application of a plaster coat or coats and prior to the application of a lath sheeting which will form a matrix or lattice for supporting the plaster when it is applied. The lath is conventionally made of chicken wire or expanded metal and attached with nails, staples or the like. The lath sheeting may be suspended away from the wall and boards by a furring strip or strips interposed between the surface of the wall and the sheeting. Self furred sheeting or wire may also be used to maintain the spacing between the wall and the sheeting. An example of such wire is self furred metal lath made by California Expanded Metal Products Company of Industry, Calif. "Dimpled" or ribbed type self furring metal lath provides a ¼ inch indentation in the metal lath to hold it away from the wall allowing the plaster to fill the space between, insuring the lath is embedded. The spacing between the lath and the wall or boards provides the opening for the plaster coat to surround the lath and thereby bond firmly to the wall. A moisture barrier layer, of building paper, for example, is applied between the boards and the lath sheeting by means of staples, nails, an adhesive coating or the like.

The boards provide the relief pattern or bump-out desired. Additional screening is cut and shaped by hand to conform to the protruding bump-out and nailed or stapled to the boards and the wall.

Plaster is then applied to the bump-out and the wall to form the finished surface.

With reference to FIG. 10A, there is shown a schematic diagram of an exploded view of one previous art method of assembly for a manually fabricated plaster relief form as described above. A plurality of boards of desired width with the same cross section are aligned end to end and nailed to the prepared wall to form a continuous plaster relief band to the desired length. Additional lengths of wire screen or lath sections may be placed over the boards and formed by hand to the contour of the boards. The additional sections are then typically nailed in place. FIG. 10B illustrates a cross section of such a relief form having a board attached to a stud framed wall. A layer of moisture barrier paper and metal screen or lath are typically placed against the wall and attached by nails to the studs. A plurality of spacers, such as furring strips or dimples in the additional screen sections, are provided between the boards and the additional wire screen sections to allow the subsequent plaster layer to flow into the openings of the wire screen sections and fill the space between the screens and the top of the boards. Plaster is then typically applied by hand using a hawk and trowel method or applied with a nozzle connected to a machine as described above.

With reference to FIG. 10C, an additional improvement to the previous art method is shown. Guide edge members are attached, typically by nailing into the form boards, to the edges of the wire screen sections over the plaster form boards. The guide edges are spaced apart from and aligned to be parallel with the plaster form boards. The guide edge members provide a guide to the trowel or plaster dispensing nozzle as the plaster is applied, thereby allowing a uniform depth of plaster to be applied easily. Representative guide edge members used in the trade are made from 14 gauge wire such as the "CEMCORNER" corner reinforcement made by Cemco, Covina Lane, Calif. Or the "CornerAid" cover nose wire made by Stockton Products, Burbank, Calif.

The above-described method requires a number of hand operations, such a nailing the boards, cutting the additional wire screen sections, hand forming the screen sections over the boards and attaching the guide edge members, which significantly increases the cost of applying plaster relief bands. It would be an advantage to provide a system to reduce the number of hand operations required to apply plaster relief bands.

It is important to select boards made of wood which are of uniform cross section, in order to achieve a visually pleasing effect. Boards which are not uniform in thickness or width will show angular offsets at the ends where they meet. It is also important to select wood which is well cured and has stable dimensional shape. If the wood twists or otherwise deforms after the plaster has dried, unsightly cracks may appear. Cracks may also allow moisture to penetrate the plaster and attack the wood beneath, or provide additional unwanted access to wood destroying pests. Boards of suitable quality currently sell for $2 to $3 per linear foot. On a double band board structure, the cost could be from $15 to $18 per linear foot, after including the costs of boards, lath application and finished plaster.

The use of wood for forming the support structure for the plaster of decorative bands is well known in the trade. As the costs of wood continue to increase, and the availability of high quality boards continues to diminish, there is an urgent need to provide an alternative low cost structure which will satisfy the desire for aesthetic enhancements to the various stucco and plaster styles of home and office.

The non-uniformity of wooden boards in width and thickness can cause unsightly mismatch in the appearance of the relief bands on a home. Either higher quality and thus higher cost boards must be purchased, or labor intensive and expensive modification must be made on the job site. This slows down the assembly process and further adds to the cost of building. It would be an advantage to provide a support structure for plaster relief bands which would guarantee uniformity in cross section aspect and thus match precisely when aligned at the ends.

The weight of the wood used for the band support structure creates several concerns. Handling and aligning long lengths of boards takes considerable strength and capability. Moving and holding a 12 foot length of board may require two workers to align successive boards. The cost of shipping the wood used in making the band supports is also a factor in the cost of building plaster or stucco homes. Wood often is shipped in a condition wherein it contains an appreciable amount of water which significantly increases the weight of the wood. Wood typically contains 30% or more water by weight. Such additional weight is of no use and in fact may be harmful as described above. Wood used for decorative support may also be stored outdoors while awaiting construction. It is possible for the wood to absorb moisture from the surroundings thereby increasing its' weight even if it had been shipped in an originally dry state. It would be an advantage to have a band support structure which is lighter in weight, thereby reducing the cost and time of installation and the cost of shipping to the job site. It would be an additional advantage to provide a band support structure which could not absorb water while stored at a building site.

The use of wood as a building material combined with increased demands from a growing population puts increasing pressure on our forest preserves. It would be an advantage to provide a substitute material which would reduce the need to use wood except where it is most effective, thereby preserving our valuable resources.

Even though the wood for plant on bands is covered by fire-resistant plaster, the building codes still require the bands to be considered flammable structures. It would be an advantage to provide a substitute material which was impervious to fire, and thereby add increased safety to homes and buildings.

SUMMARY OF THE INVENTION

The general purpose of the invention is to provide light weight, low cost prefabricated plaster relief form members which can be shipped to a construction job site in final form to simplify the application of relief bands to the exterior of homes and buildings which are to be coated with a cementitous coating, typically plaster or stucco.

According to one embodiment of the invention a prefabricated plaster relief form member is provided for receiving and retaining a fluid cementitious coating, such as plaster, when the member is attached to a prepared structural wall.

The member is configured from an openwork lattice sheet, preferably of an expanded metal lath. The lattice sheet is adapted to receive and retain the plaster when the plaster when the plaster is applied by hand or by spraying with a nozzle of a machine. The lattice sheet is formed into a longitudinal channel having a top with opposed outer edges.

Two spaced apart sides extend away from the respective opposed outer edges, to respective base edges. The respective base edges are aligned parallel to the top such that a mounting plane is defined parallel to the top of the channel.

Two mounting flange portions, each extending outward and away from the base edges of the respective sides, lie within the mounting plane parallel to the channel.

The member is thus defined as a channel having a length between two opposed ends and a width between the two opposed sides. The channel is configured to have an essentially uniform lateral cross section, perpendicular to the longitudinal dimension, protruding away from the mounting plane.

The flange sections are adapted for mounting to the prepared structural wall such that a plurality of such members mounted on the structural wall and adjoined end-to-end form a continuous relief band protruding from the wall. The flange sections may be nailed or stapled to the studs of a prepared wall after adjacent form members are aligned and adjoined end-to-end.

The regular cross section of similar prefabricated form members ensures an aesthetically pleasing effect is easily achieved without shaving, trimming or selecting wooden boards.

The light weight and regular shape of these prefabricated members enable for easy and low cost installation of the support forms needed for applying relief bands to stucco homes and buildings.

The metal lath or lattice work is light, but has sufficient strength to support the plaster coating and hold it in place while it cures. The prefabricated shape enables the construction of plaster relief bands without the use of wood boards and the additional weight and shipping cost involved. The cells and strands of the lattice work provides openings for the plaster to flow and provides a secure network for the plaster to take hold while it hardens.

The uniform shape of the form member is dimensionally stable and not subject to absorbing water. This eliminates the potential of warping that occurs with the use of wood as support members for relief bands.

The combination of the structural support and the open lattice in the one element of the prefabricated form member reduces the labor that otherwise is involved in attaching sheets of screen wire to the wood planks used in conventional construction.

In another embodiment of the prefabricated form member, there is provided at least one edge guide segment parallel to and spaced apart a preselected distance from at least one of the channel outer edges. The edge guide segment is aligned parallel to the length of the member and is configured to provide a guide edge for a tool. A connecting frame is provided for rigidly connecting the edge guide segment to the member such that the edge guide segment provides a secure guide edge for a tool used to apply the plaster or stucco coating to a preselected thickness along the length of the member. A preferred thickness of plaster coating is about ⅞ inch minimum in the finished state.

The prefabricated form member is typically formed from expanded, galvanized metal having a preformed weight of about 3.4 pounds per square yard. The lattice is shaped into an array of elongated hexagons, the hexagons having a major axis of about ½ inch and a minor axis of about ⅜ inch. The adjacent hexagons along the minor axis being connected at opposed sides by respective common side segments of about ⅛ inch in length, and adjacent hexagons along the major axis being connected at the ends of respective ⅜ inch common end segments, while the respective side and end segments are connected by corresponding right and left angled linking segments.

A prefabricated form member as described above is non-permeable to water, non-flammable and semi-rigid and has a lateral strength sufficient to support a plaster coating having a thickness from about ½ inch in thickness, to about 2 inches in thickness.

It is an advantage in accordance with this invention to provide plaster relief form members which eliminate the use of lumber in achieving architectural enhancement effects.

It is a further advantage in accordance with this invention to provide plaster relief form members which reduce cost of installation.

It is a further advantage in accordance with this invention to provide plaster relief form members which are lower in weight than equivalent lumber elements.

It is a further advantage in accordance with this invention to provide plaster relief form members which reduce the cost of shipping members to the job site.

It is a further advantage in accordance with this invention to provide plaster relief form members which are uniform in cross section and impervious to warping or cracking.

It is a further advantage in accordance with this invention to provide plaster relief form members which reduce the number of hand operations and thereby reduce the cost of installation.

It is a further advantage in accordance with this invention to provide plaster relief form members which are non-flammable.

It is a further advantage in accordance with this invention to provide plaster relief form members which may be mass-produced in a wide variety of standard shapes at low cost.

It is a further advantage in accordance with this invention to provide plaster relief form members which can be easily joined end-to-end to form visually uniform relief bands on outer walls, around door or window openings and along the facia of a building. The relief bands have stable shape with age and are resistant to warping and cracking due to moisture absorption/desorption.

It is a further advantage of the present invention to use welded wire lath to form the form member absent any other structural support member.

It is a further advantage to add edge guides to the welded wire form member.

It is a further advantage to form the member out of rib lath, preferably by placing the rib members at the corners of the top and sides of the channel and in addition to depress the top from the corners so that the ribs provide edge guides, and absent any other structural support member.

It is a further advantage to form the member out of woven wire lath also known as chicken wire, and preferably of the self furring form, absent any other structural support member, and in addition, preferably with edge guides applied to the corners of the top and side of the channel.

It is a further advantage, where edge guides applied to corners of the top and sides of the channel are cut-down to have shorter side extensions.

BRIEF DESCRIPTION OF THE DRAWINGS

For a further understanding of the objects and advantages of the present invention, reference should be had to the following detailed description, taken in conjunction with the accompanying drawings, in which like parts are given like reference numerals and wherein;

FIG. 11 is a perspective exploded diagrammatic view of a channel formed from welded-wire lath in accordance with this invention.

FIG. 12 is an end view of a preferred form of the invention shown in FIG. 11 in accordance with this invention.

FIG. 13 is a diagrammatic view of the invention as shown in FIGS. 11 and 12 with edge guides added, in accordance with this invention.

DETAILED DESCRIPTION OF A PREFERRED EMBODIMENT OF THE INVENTION

Figure 1:
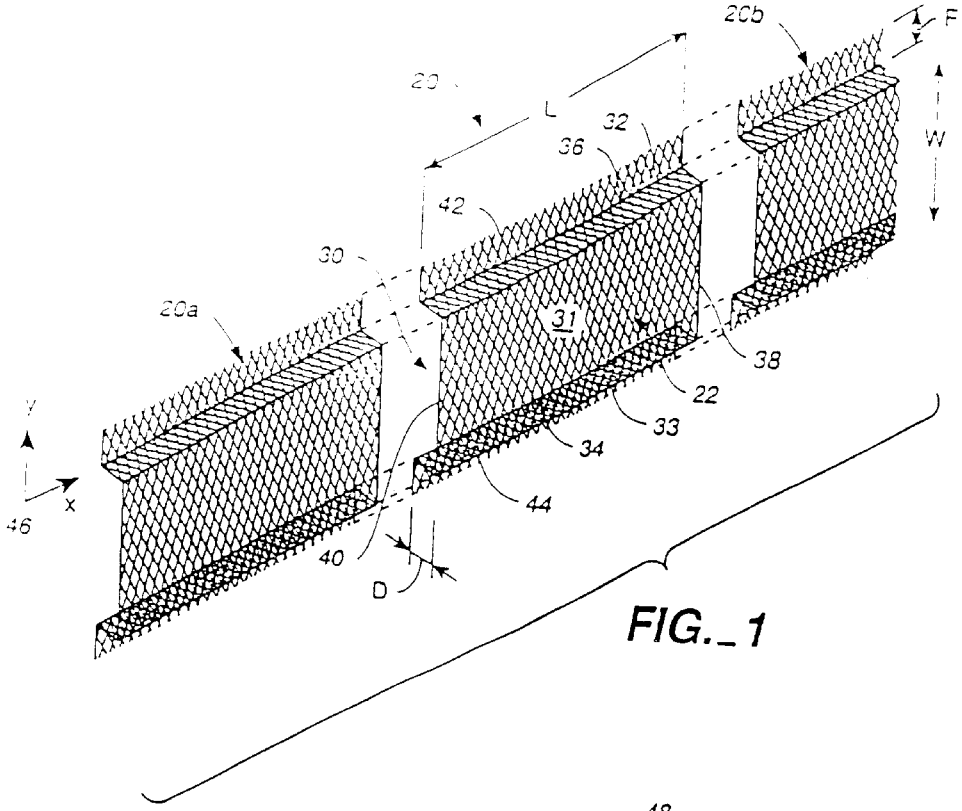
FIG. 1 is an exploded perspective view of prefabricated plaster relief forms members aligned end to end in accordance with this invention.

With reference to FIG. 1, there is shown an embodiment of the prefabricated plaster relief form member in accordance with this invention, generally referred to by the numeral 20. The member 20 is shown aligned end-to-end with similar members 20*a* and 20*b*. The member 20 is formed from an open lattice material 22 such as 3.4 lb/sq. yd. diamond mesh expanded metal made by Western Metal Lath Company of San Leandro, Calif. The lattice material 22 is bent on a tool such as a sheet metal brake in a metal shop to form a longitudinal channel having a protuberant contour 30 with a top surface 31, opposed sides 34, 36 at essentially right angles to surface 31, and opposed ends 38, 40. The sides 34, 36 of lattice material 22 are bent to form flanges 42, 44 extending at essentially right angles away from the respective sides 34, 36 of the member 20. The flanges 42, 44 are configured to lie in the same mounting plane 46 indicated by the arrows x, y. The mounting plane 46 and flanges 42, 44 are essentially parallel to the length L of the member 20. The depth D of the member 20 is typically about 1½ inches, the width W typically about 6 to 12 inches and the length L typically 6 to 10 feet. The flanges 42, 44 extend a distance F typically about 1½ inches respectively from each side 34, 35. The member 20 is configured so that each end 38, 40 can abut contiguously at each end 38, 40 with adjacent identical members, as indicated by members 20*a* and 20*b*, to form a continuous relief band when mounted on a prepared structural wall. The application and method of use of prefabricated plaster relief bands is described below.

The members 20, 20*a*, 20*b* would typically be fabricated at a remote site, such as a metal shop or manufacturing plant by using tools well known in the metal working trade.

A preferred manufacturing method for the prefabricated members 20 is an automated means such as high speed punches and presses operated with appropriately configured molds to achieve a desire contour. Finished members 20 would then be shipped to a job site for installation by lower cost tradespeople.

Figure 2:
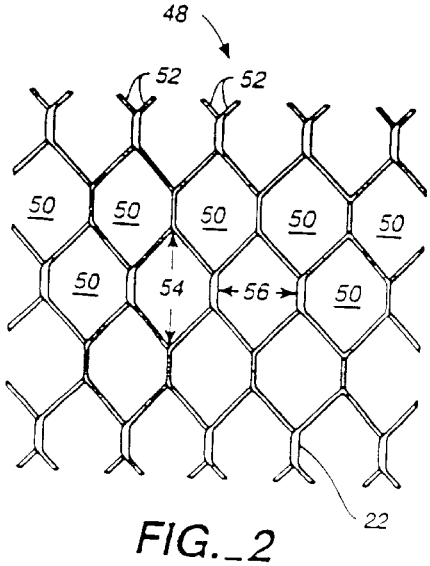
FIG. 2 is a plan view of a section of expanded metal lath used as the open work lattice material to make a preformed plaster relief form member in accordance with this invention.

With reference to FIG. 2, there is shown a detail of a typical lattice material 22. A preferred lattice 22 is typically formed of galvanized steel expanded to provide an hexagonal close packed array 48 of cells 50 bounded by strands 52. The strands 52 are formed of galvanized sheet steel typically about 0.020 inches thick. The cells 50 are elongated hexagons with major axis 54 about 11/16 inch long and minor axis 56 about 5/16 inch wide. Alternatively, the lattice 22 may be formed of lighter or heavier expanded metal, such as 1.75 lb/sq. yd. Or 2.5 lb/sq. yd. For smaller or larger preformed members. A suitable material is the galvanized steel diamond mesh of 3.4 lb/sq. yd. Made by Western Metal Lath Co. La Mirada, Calif.

Figure 3:
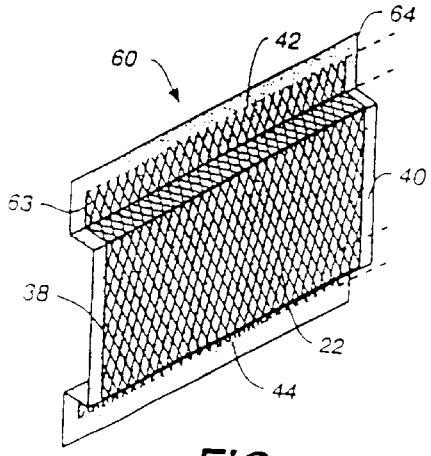
FIG. 3 is a perspective view of an alternative prefabricated relief form member having a paper backing.

With reference to FIG. 3, an alternative embodiment of a prefabricated plaster support member in accordance with this invention is shown. A paper backed lattice material may be used to make a member generally indicated by numeral 60. An example of such a paper backed lattice material is "CEM-LATH K" made by Cemco, of Industry, Calif. "CEM-LATH K" is a 3.4 lb/sq. yd. Diamond mesh metal lath 62 backed with asphalt saturated "Kraft" paper 64 which may be used to form a plaster support member 60 in accordance with this invention. The paper backing 64 may be used to limit the amount of plaster which is needed to cover the member 60 after the member 60 is applied to a prepared structural wall (not shown).

The paper 64 extends a suitable distance such as 1½ to 2 inches beyond the flanges 42, 44 and 3nds 38, 40 of the metal lath 62. The paper 64 extension provides an overlap with adjacent paper backed members (not shown), when aligned end to end, to ensure a continuous moisture barrier which may be required by local or state building codes.

It is contemplated that the paper 64 may be applied to the back of the lath 62 before forming the member 60. Application of the paper 64 to the back of the lath 62 may be made by adhesive means such as a hot glue (not shown) between the paper 64 and the lath 62. The paper 64 and the lath 62 may then be positioned between an upper mold and a lower mold having a desired shape (not shown). Application of sufficient pressure between the upper mold and lower mold will cause the lath 62 and paper 64 combination to be shaped into the desired member 60.

Figure 4:
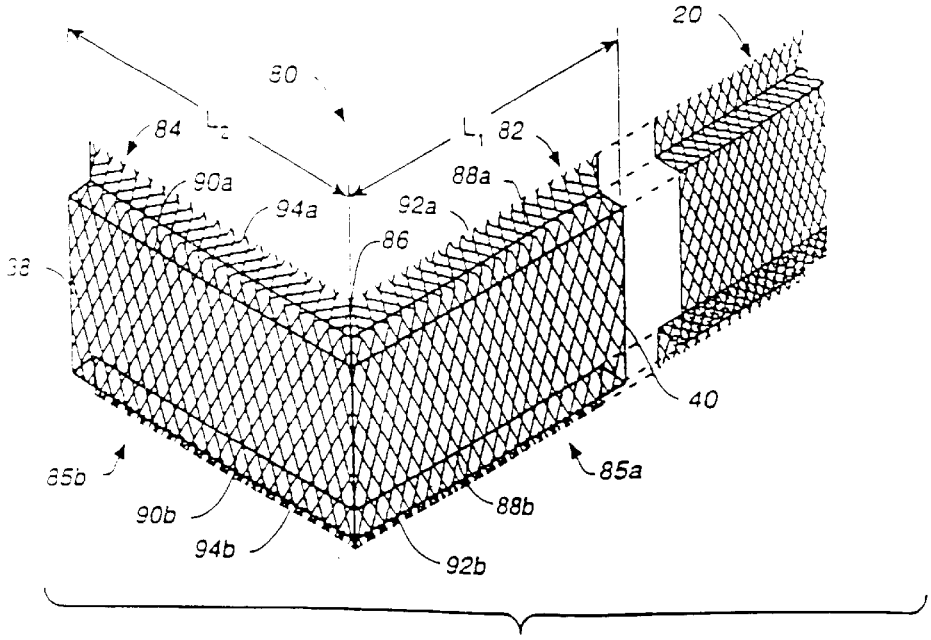
FIG. 4 is a perspective view of an alternative prefabricated plaster relief form member angled to fit around intersecting walls.

Other preformed shapes for prefabricated plaster form members in accordance with this invention are contemplated. With reference to FIG. 4 there is shown an embodiment of a prefabricated angled member 80. The angled member 80 provides a means to fit a continuous relief band around the corner of a building (not shown) without cutting and fitting straight members. The member 80 is made from open work lattice material as described above. The member 80 includes a first portion 82 and a second portion 84 joined at a common edge 86. The portions 82 and 84 may be joined by suitable means such as spot-welding, hot gluing or wire tying, as is well known in the trade. The portion 82 and portion 84 are indicated at right angles to each other, but can be any desired angle to accommodate intersecting structural walls at other than 90 degree angles. The portions 82, 84 are configured to have similar protuberant cross sections and protrude in a direction normal to the respective intersecting walls. The portions 82, 84 have respective lengths L1 and L2 measured from the common edge 86 to respective ends 38, 40. The portions 82 and 84 have top surfaces 85*a*, 85*b* intersecting at edge 86. The portions 82 and 84 have respective sides 88*a*, 88*b*, and 90*a*, 90*b* between the respective walls and respective top surfaces 85*a*, 85*b*. Mounting flanges 92*a*, 92*b* and 94*a*, 94*b* project outward from respective sides 88*a*, 88*b*, and 90*a*, 90*b*. Flanges 92*a*, 92*b* and 94*a*, 94*b* are configured to lie in intersecting mounting planes and are adapted to fit parallel to the respective adjacent intersecting structural walls.

The member 80 is attached to the studs of a prepared structural wall by means of nails or staples driven through the respective flanges 92*a*–94*b*. Self-tapping sheet metal screws are typically used to attach the flanges 92*a*–94*b* to metal studs. Sharp pointed "Streaker" self-tapping sheet metal screws available from Pacific Steel and Supply, San Leandro, Calif., may be used for light gauge metal studs.

The ends 38 and 40 of member 80 are configured as before to abut or overlap contiguously with respective ends of prefabricated plaster form members having the same cross section as the member 80. One such abutting relationship with a plaster form member 20 having the same cross section as member 80 is indicated by the exploded view of member 20 shown in FIG. 4.

Figure 5:
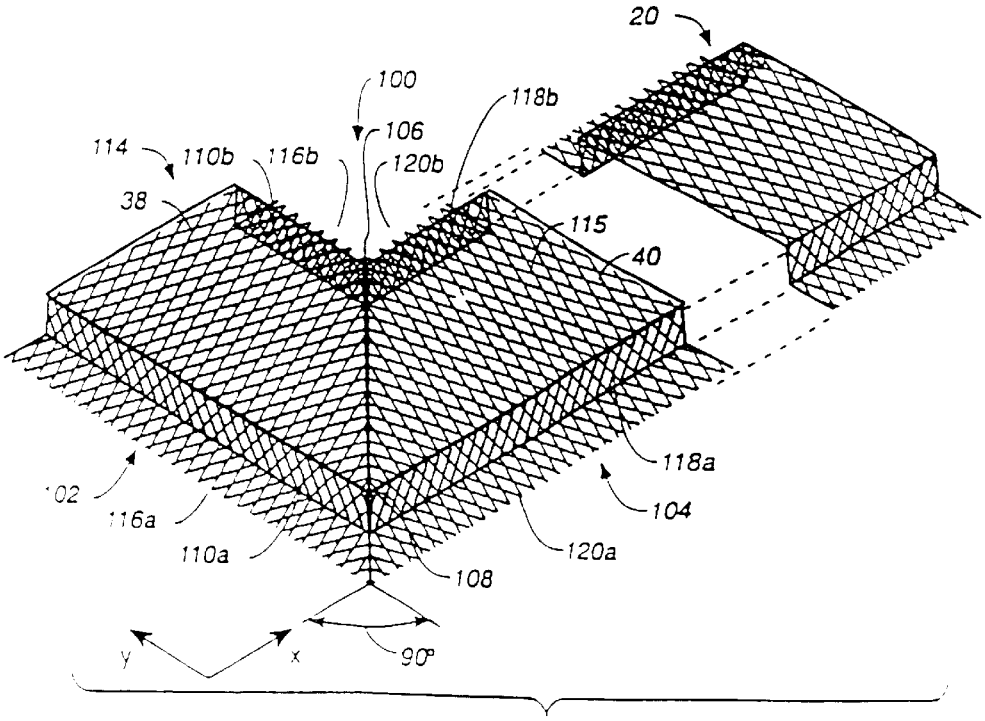
FIG. 5 is a perspective view of an alternative prefabricated plaster relief form member angled to fit around door or window casings.

It is often desired to fit the perimeter of door or window openings with decorative plaster elements. With reference to FIG. 5, another embodiment of an angled prefabricated plaster form member in accordance with this invention is shown and generally indicated by numeral 100. In one embodiment, the member 100 is made from expanded metal lath as before described. A first portion 102 is joined with a second portion 104 at a common edge 106. Portion 102 includes a sheet of expanded metal lath bent for form spaced apart sides 110*a* and 110*b*, a top surface 114 and respective mounting flanges 116*a* and 116*b*. Portion 104 includes a sheet of expanded metal lath bent to form spaced apart sides 118*a* and 118*b*, a top surface 115 and respective mounting flanges 120*a* and 120*b*. Portions 102 and 104 are configured to be symmetrical about the common edge 106. The mounting flanges 116*a*, 116*b*, 120*a* and 120*b* lie in the same mounting plane indicated by arrows x, y. Flanges 116*a*, 116*b* and 120*a*, 120*b* are connected to the respective top surfaces 114 and 118 by the depending sides 110*a*, 110*b* and 118*a*, 118*b*. The top surfaces 114, 115 lie in the same plane and are parallel to the mounting flanges 116*a*, 116*b*, 120*a*, 120*b*.

Alternative Preformed Plaster Relief Form Member

Figure 6:
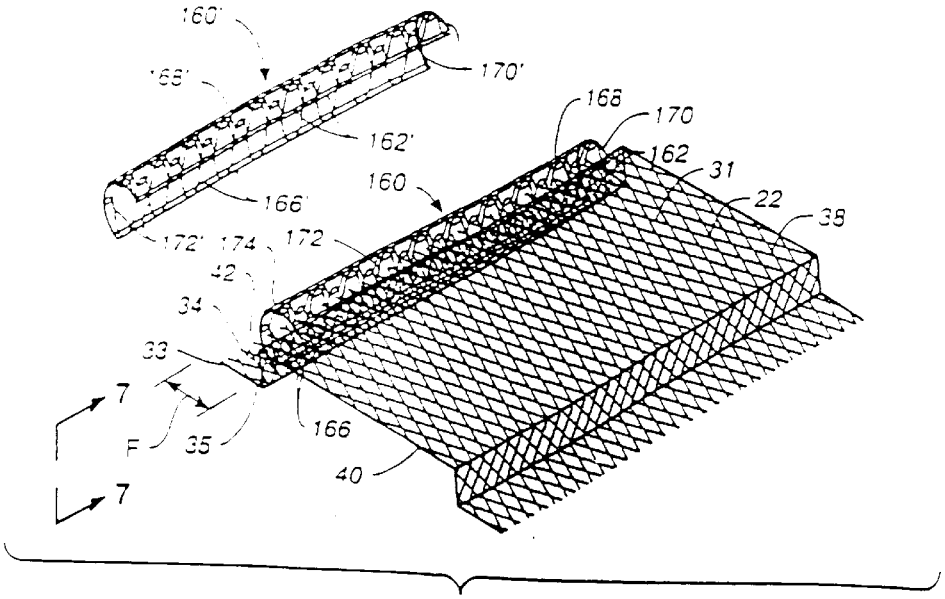
FIG. 6 is a perspective view of an alternative prefabricated plaster relief form member having a prefabricated guide edge member in accordance with this invention.

The previous art method of attaching separate guide edge members to the hand formed plaster relief forms incurs extra handling and additional cost due to high rate labor charges. With reference to FIG. 6, there is illustrated a perspective view of a portion of an alternative preformed plaster relief form in accordance with this invention, and generally referred to as numeral 150. As before described with reference to FIG. 1, wherein similar reference numerals are used to designate similar elements, the member 150 is formed of an open work lattice material 22. A preferred lattice material is a diamond mesh expanded metal such as 3.4 lb/sq. yd galvanized metal lath made by CEMCO of Covina Lane, Industry, Calif. The lattice material 22 of member 150 is preformed to include a top surface 31 having opposed ends 38, 40. The top surface 31 has bending line along the surface 31. The bending line is normal to the opposed ends and defines an edge 33. The lattice material 22 is bent along the edge 33 to define a side 34 extending downward from the top surface 31. The side 34 extends downward a suitable distance from the top surface 31, to a second bending line 35, for example, 1½ inches. The lattice material 22 is bent along the second bending line 35, to form a mounting flange 42 extending laterally outward from the side 34 of the member 150 to a suitable distance F, e.g. 1½ inches. A similar bending line, edge, side and flange (not shown) may be formed in a symmetrical relationship to the side 34 as before described and shown in FIG. 1.

A prefabricated guide edge member 160 is shown in exploded relationship to the member 150 as member 160 for clarity. Guide edge member 160 is attached at a plurality of points 162 along a first edge 164 to the top surface 31 of the member 150. The edge member 160 is attached at a second plurality of points 166 to the side 34 of member 150. The method of attachment may be spot welding, or bonding with an adhesive such as hot glue. A preferred guide edge member 160 is the standard Bullnose regular cover nose wire having standard 1½ inch legs made by Stockton Products, Covina, Calif. The guide member 160 includes a guide edge 168 spaced apart from, and parallel to, the intersection of the top surface 31 and the side 34. The guide edge 168 is spaced apart a suitable distance, e.g. ⅝ inch from the top surface 31 of the member 150. The guide edge 168 provides an edge to guide a tool, such as a trowel, while applying plaster to the member 150, in such a manner that a uniform plaster coating thickness is easily achieved on the top surface 31. The guide member 160 includes a plurality of wire support members 170 and 172 connecting the guide edge 168 and the respective top 31 and side 34 of the member 150. A similar guide edge 174 spaced apart form the side 34 by a suitable distance, e.g. ⅝ inch provides an edge to guide a tool along the member 150 to achieve a uniform plaster coating thickness along the side 34.

The exploded view of the member 160 illustrates corresponding attachment points 162 and 166, the connecting wires 170' and 172' and the guide edge 168'.

Figure 7:
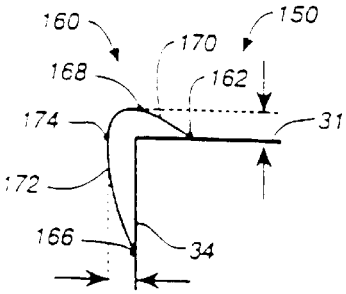
FIG. 7 is a cross section taken along viewing plane 7—7 of FIG. 6.

With reference to FIG. 7, there is shown in cross section along the viewing plane indicated by 7—7 of FIG. 6, the contour of the edge guide member 160 attached to the top 31 and the side 34 of the member 150 at attachment points 162, 166 respectively. The top guide edge 168 and side guide edge 174 are shown as wires attached to the connection wires 170 and 172 and spaced apart from the top surface 31 and the side 34 by a suitable distance, typically ⅝ inch.

Alternative Cross Sections for Prefabricated Plaster Relief Forms

Figure 8A:
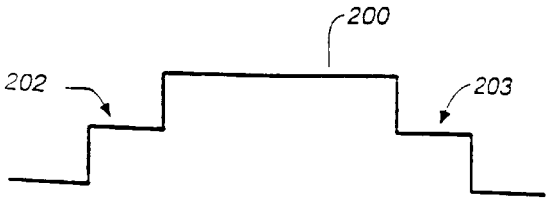
FIGS. 8*a* and 8*b* are cross sections of two alternative plaster relief form members in accordance with this invention.
Figure 8B:
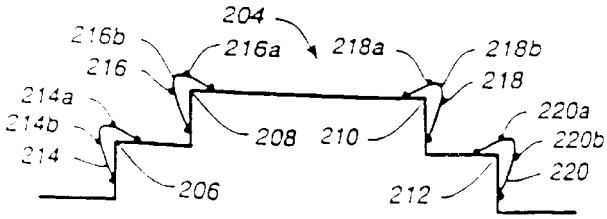

With reference to FIGS. 8*a* and 8*b* there are shown alternative cross sections for prefabricated plaster relief form members in accordance with this invention. FIG. 8*a* illustrates a member 200 having opposed sides 202, 203 configured in a stair-stepped shape to provide two layers of relief.

FIG. 8*b* illustrates a cross section of a prefabricated plaster relief form member 204 having a stair-stepped aspect with four corner edges 206, 208, 210, 212. Each edge 206–212 has a respective guide edge members 214, 216, 218, 220. Each guide edge member 214–220 provides a top and a side guide edge 214*a*, *b*–220*a*,*b* spaced apart from the respective corner edges 206–212 by a suitable distance, e.g. ⅝ inch laterally outward and vertically upward.

Figure 9:
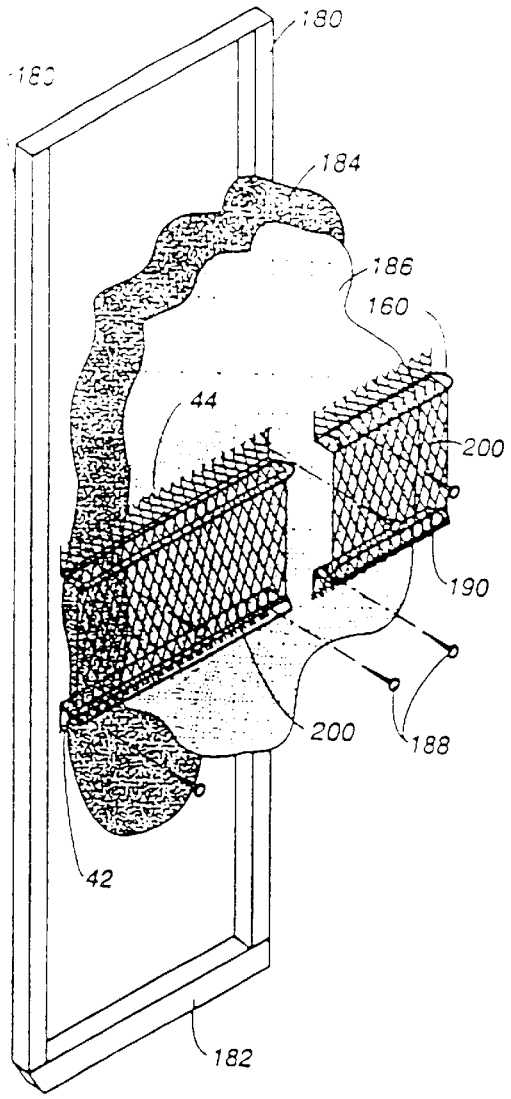
FIG. 9 is an exploded perspective view of two plaster relief form members aligned end-to-end on a structural wall.
Figure 10A:
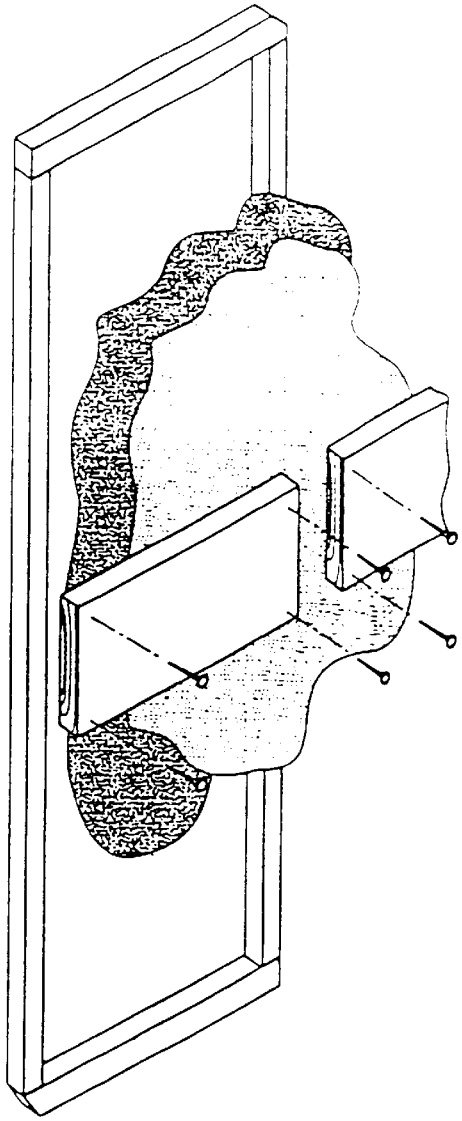
FIG. 10A (PRIOR ART)
FIG. 10A is a perspective view of a previous art method of attaching hand made plaster relief forms made of wood and wire screen.
Figure 10B:
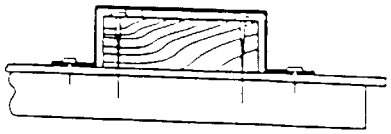
FIG. 10B (PRIOR ART)
FIG. 10B is a cross section of a previous art hand made plaster relief form.
Figure 10C:
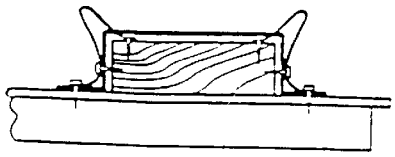
FIG. 10C (PRIOR ART)
FIG. 10C is a cross section of a previous art hand plaster relief form having separate guide edge members manually attached.

With reference to FIG. 9, the use of the prefabricated plaster relief form is herein described. In use, a structural wall is prepared having a plurality of studs 180 spaced a suitable distance apart and mounted vertically along a foundation 182. A layer of asphalted "Kraft" paper 184 for a moisture barrier is applied to the studs 180. A first layer of wire mesh or screen 186 (commonly called chicken wire) is then attached to the wall over the paper 184. A line is defined along the wall wherein the desired decorative architectural structure was to be placed. A plurality of prefabricated plaster relief form members 200 is aligned end to end along the line and attached to the wall by means of nails or staples 186 driven through respective mounting flanges 42, 44 into the studs 180. The light weight but substantially rigid lattice material 22 and uniformity of shape provided by the preformed members 200 would make the task of creating a uniform, continuous relief band extremely easy. With reference again to the detail of FIG. 2, the array 48 of open cells 50 of the lattice material 22 provides ready access for the application of plaster to envelop the strands 52 and bond firmly with the lattice 22.

The prefabricated guide edges 160 and 190 of the preformed plaster relief form 200 provide guides for guiding a tool to apply plaster to a uniform thickness along the relief form members 200.

One method of applying a cementitious coating is the well known three step process. A first coat of cementitious material, typically plaster, called a scratch coat, would be applied, either by hand trowel or by spraying from a nozzle connected to a gun feeder, hopper/mixer and pumps as is well known to those skilled in the art.

One preferred formulation for the scratch coat is set forth in Table 1. It is within the teachings of this patent to use any other suitable cementitious material to form the coating for the wall and prefabricated plaster form 20.

TABLE 1

| |
|---|
| 1 part Colton Portland Cement type II |
| 3 parts common coarse sand |
| 5 to 8 gallons of water per sack of cement, depending on the water content of the sand |

The scratch coat covers the wall and the sides and top surface of the form members 20 to a uniform depth of about ⅜ inch. The scratch coat is cured for a suitable time, such as 24 to 48 hours, according to the State of California Uniform Building Code 1988 Edition page 4706, herein incorporated by reference.

A second coat of plaster about ¼ to ¾ inches, with a preferred thickness or ⅜ inch, called the brown coat, is applied similarly to the wall and plaster forms 20. The brown coat is cured for a suitable time such as 7 to 14 days minimum. A suitable formulation for the brown coat is the same as Table 1, with the addition of a 3 to 5 shovelsful of sand per sack of cement.

A final plaster coast incorporating the desired color is applied similarly to a depth of about 1/16 to ⅛ inch. The formulation for the color coat is typically a mechanically blended compound of portland cement, hydrated lime and inert aggregates (16/20 or 20/30 sand), such as that supplied by La Habra Stucco, Anaheim, Calif. Material standards preferably meet Federal Specification SS-L-351, Type F for hydrated lime, and Type 1 ASTM C150-56: Federal Specification SS-C-192B, for white portland cement.

Further Embodiments

A further embodiment of the invention is illustrated in FIG. 11. This embodiment takes advantage of an existing product used in construction. In this embodiment the relief form member 200 is made of a metal mesh 202 of the type known as welded wire, preferably in the form of 2"×2" mesh, using 16 or 17 gauge wire. Paper backing comes attached to the wire mesh when it is made and sold as by manufacturers for plastering purposes. In this form it is referred to in the industry as welded wire lath. An example is that used in a product sold as Stucco-Rite by K-Lath of Fontana, Calif. The attached Appendix A is a copy of K-Lath's catalogue A465,09200/KLC, Bayline 5409 showing various forms of lath.

Referring to FIG. 11, the welded wire mesh 202 is formed as described above into a channel shape having mounting flanges 204, sides 206 and a top 208. The mounting flanges 204 are preferably ½ inch to 1½ inch extending away from the sides 206. The height of the side 206 is dictated by the desired design dimension, 1½ inches being exemplary. Paper backing 210 follows the form of the channel and is attached to the wire mesh 202 by an interweaving as known in its preparation as lath. The width of the top 208 is also a design choice, 6 to 12 inches being exemplary. The relief form member can be of any selected length for the use, and can be preformed in exemplary lengths such as 6 to 10 feet.

This embodiment has a further alternative in which a product known as double wire mesh is used. The double wire mesh material is used in a lath product sold as Stucco Rite Double Wire by K-Lath of Fontana, Calif., as described in the catalogue identified above. The double wires are provided at selected intervals. The double wire form provides a nailing space between the double wires to catch the nail head and prevent movement during installation.

When forming the channel shape using the welded wire mesh, the bends can be anywhere, but referring to FIG. 12, it is preferable to have lengthwise extending wires 212 at the bends or corners, as well as having a lengthwise extending wire proximate the outer termination 214. Since the welded wire mesh comes in specified dimensions, whether single or double wire, to place the lengthwise wires at the bends or corners dictates the dimensions of the channel. This structure gives additional rigidity which aids in installation. The paper backing 210 is shown attached to the wire mesh 202 by interweaving as is known in the manufacture of welded wire lath. A second layer of paper 215 is commonly employed having an asphaltic or other waterproofing component.

The foregoing alternatives using welded wire mesh can be used as described, or with corner beads also known as edge metal or edge guides as previously described and shown diagrammatically in cross-section in FIG. 13. Corner beads are sold by various manufacturers such as CEMCO of Industry, Calif. Appendix B is a copy of CEMCO's catalogue of Metal Lath and Accessories. Without the corner beads, certain architecture styles such as Spanish or mission finish are facilitated. With the corner beads or edge guides, a smooth finish is achievable. The corner beads can be attached by any suitable means, such as by hot glue. Referring to FIG. 13 the wire mesh 202 has corner beads 216 attached at the corners of the top 208 and sides 206. Paper backing 210 is shown.

Figure 14:
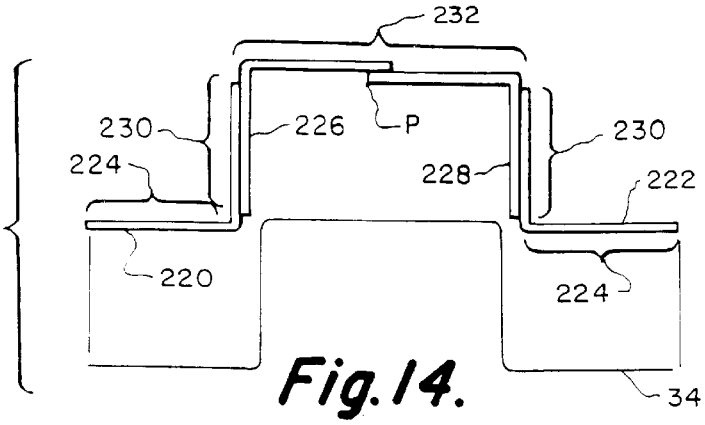
FIG. 14 is a diagrammatic, exploded end view, of a form member made from edge guides in accordance with this invention.

Another alternative construction of the invention uses only corner bead members joined together to form the channel. This is shown diagrammatically in FIG. 14 in which corner beads 220 and 222 form the flanges 224 and along with corner beads 226 and 228, form the sides 230 and the corner beads 226 and 228 form the top 232. To form the top 232, corner beads 226 and 228 may overlap as shown at P although they can abut. The four corner beads are joined along their length by any desired means such as wire ties, welding or hot glue. Also, paper backing 234 is applied, held in place such as by hot glue, and can include an asphalt coated layer. The corner beads can be any known type, such as bullnose, or straight wire edge guides.

Figure 15:
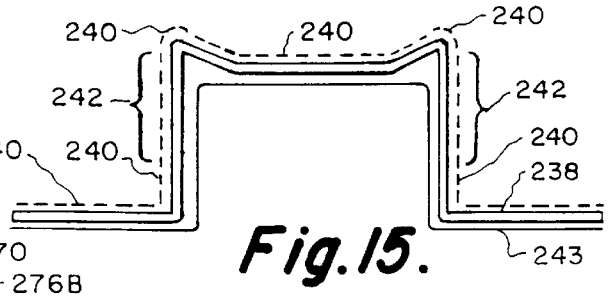
FIG. 15 is a diagrammatic end view of a form member made from rib lath in accordance with this invention.

Referring to FIG. 15, in another alternative the channel is constructed by using a product known as rib lath. Rib lath is a known product, similar to the expanded metal described above, but having parallel ribs of solid, unexpanded portions extending lengthwise between areas of expanded metal. The rib lath is shown in the CEMCO catalogue. The ribs may be about ⅜" wide and spaced apart about 1⅛ inch with three expanded portions between them. Referring to FIG. 15, the rib lath 238 has the ribs 240 and the expanded metal portions 242 between the ribs. The rib lath 238 is formed into a channel shape as shown diagrammatically having raised corners where the sides and top meet with ribs 240 at the corners to serve as edge guides. In FIG. 15, the longer lines 240 represent the ribs and the shorter lines and spaces 242 represent the expanded metal portions. The rib lath structure is preferably also used with paper backing as described above. In this form the corner bead or edge guide is built into the channel form itself. The sides of the channel could be convergent from top to flange to provide an edge guide for the sides, or the sides could be bent, like the top so that the corner protrudes to provide an edge guide for the sides.

Figure 16:
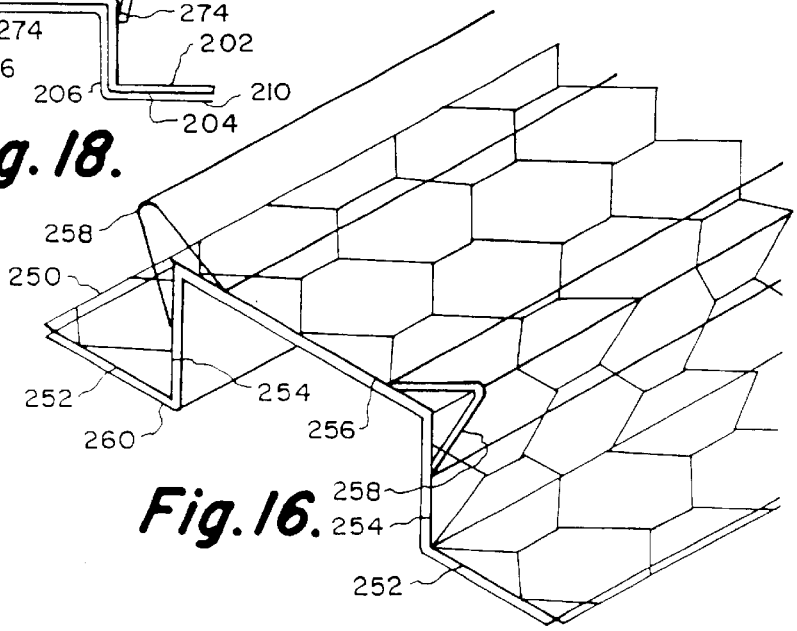
FIG. 16 is a diagrammatic perspective view of a form member made from woven wire also known as chicken wire, with edge guides attached in accordance with the invention.

Referring to FIG. 16, in another alternative series of structures any of the foregoing shapes can be formed using woven wire also known as chicken wire for the basic channel shape. This wire is referred to as Stucco Netting in the K-Lath Catalogue. It is preferably augmented with paper backing and as desired with corner beads as described above. The self-furring form is preferred to keep a space between the wire and the paper backing. The woven wire is formed into a channel 250, with flanges 252, sides 254 and top 256. Corner beads 258 are attached as well as paper backing 260.

Figure 18:
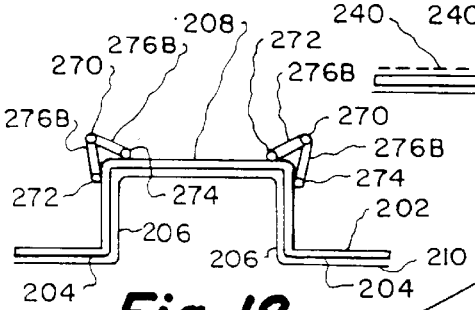
FIG. 18 is a diagrammatic end view of a generic form member with a cut-down edge guides in accordance with the invention.
Figure 17A:
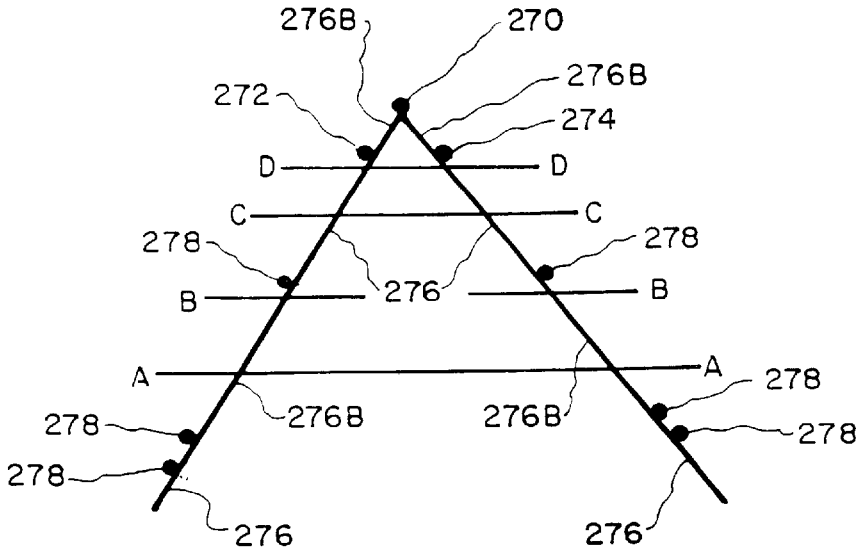
FIG. 17*a* is an end view of a type of corner bead.
Figure 17B:
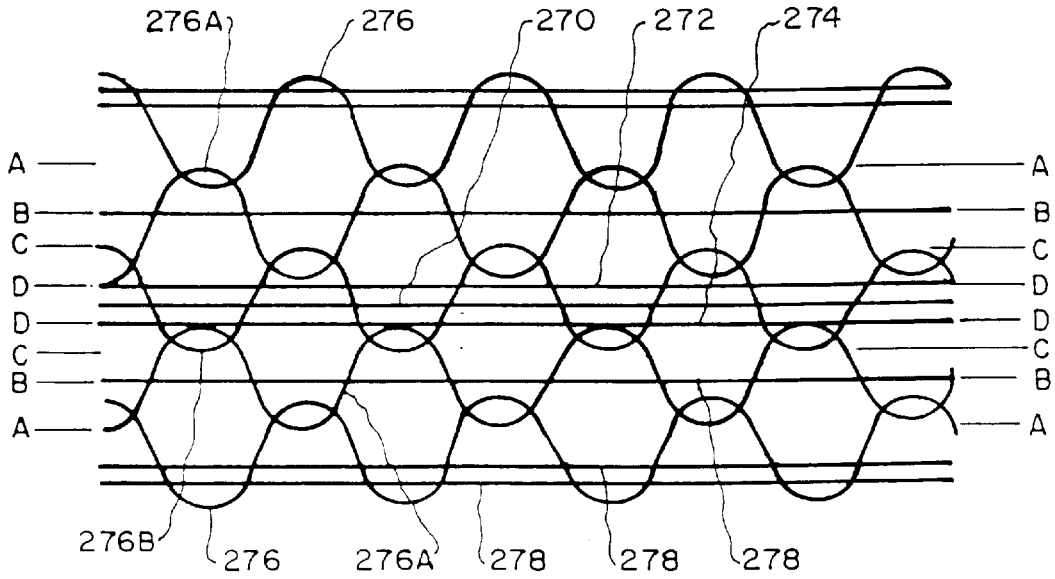
FIG. 17*b* is a top view of the corner bead of FIG. 17*a* with the side extensions rotated into a plane.

Corner beads are commonly made with lengthwise wires at the apex to form a bullnose or straight shape and undulating and straight wires combined to provide an extension away from the apex. In the CEMCO catalogue this is shown on page 8 as CEMCORNER. FIGS. 17*a* and 17*b* shows this structure with lengthwise wires 270, 272 and 274 defining an apex, and the remainder of the structure of undulating wires 276A and 276B and straight wires 278 forming side extensions away from the apex. In the present invention, referring to FIGS. 17*a* and 17*b,* this type of corner bead can be used as shown in the CEMCO catalogue, but in a further embodiment the side extensions can be cut away to make it smaller. Selected places for lengthwise cutting away are shown at A—A, B—B, C—C and D—D. The form created by the cutting away along line D is shown in FIG. 18.

In all of these alternative constructions, no underlying structural support member is used. In particular any wood boards are absent.

In all of these further embodiments, the shape of the channel can be made in the stepped form as shown in FIGS. 8*a* and 8*b* except that the channel is made of materials as described in these further embodiments and absent any additional underlying support such as wood boards.

While the foregoing detailed description has described the embodiments of the plaster relief form member in accordance with this invention, it is to be understood that the above description is illustrative only and not limiting of the disclosed invention. It will be appreciated that it would be possible to modify the type of lattice material to include larger or smaller cells and strands, to modify the shape of the cells and the material, to modify the cross section to include non-uniform shapes, to add other structures to the plaster relief form member such as flashing for interfacing with roofing members, to modify the coating of that lattice material by paints and/or other rust preventative materials or to include or exclude various elements within the scope and spirit of the invention. Thus the invention is to be limited only by the claims as set forth below.

What is claimed is:

1. A prefabricated relief form member for receiving and retaining a cementitious coating when the form member is attached to a prepared structural wall, the member comprising;

a first pair of corner bead members forming oppositely extending flanges and spaced apart sides;

a second pair of corner bead members placed to have one side extension extending adjacent said spaced apart sides to form double-walled spaced apart sides and the other side extension to form a top portion;

a means for holding the corner bead members together to define a channel;

paper backing fixed to the channel; and absent any other structural support member.

2. The prefabricated relief form member of claim 1 further comprising additional corner bead members applied on the channel at the corners of the top and the sides of the channel.

3. The prefabricated relief form member of claim 2 wherein at least one of the additional corner bead members has a portion of at least one of its side extensions cut off.

* * * * *